US005228692A

United States Patent [19]

Carrick et al.

[11] Patent Number: 5,228,692

[45] Date of Patent: Jul. 20, 1993

[54] GAMING FORM

[75] Inventors: Bryan W. Carrick, Gainesville, Ga.; Stephen E. Kelleher, Rumford, R.I.

[73] Assignees: Innovative Environmental Tech., Inc., West Greenwich; Environmental Paper Products, Inc., Coventry, both of R.I.

[21] Appl. No.: 749,131

[22] Filed: Aug. 23, 1991

[51] Int. Cl.[5] ..... A63F 3/06

[52] U.S. Cl. ..... 273/139; 283/901; 283/903; 283/101

[58] Field of Search ..... 273/138 R, 139; 283/901, 903, 100-102; 162/168.3; 364/519

[56] References Cited

U.S. PATENT DOCUMENTS

| | | | |
|---|---|---|---|
| 4,095,824 | 6/1978 | Bachman | 273/139 |
| 4,599,139 | 7/1986 | Scalfarotto | 162/168.3 |
| 4,726,608 | 2/1988 | Walton | 283/96 |
| 4,885,700 | 12/1989 | Kondziolka et al. | 364/519 |

*Primary Examiner*—Benjamin H. Layno

*Attorney, Agent, or Firm*—Eckert Seasmans Cherin & Mellott

[57] ABSTRACT

A gaming form such as a lottery ticket or the like, and a method for constructing the same, employ a biodegradable and recyclable paper substrate as the base, made from recycled fibers provided with carbon black for a high degree of opacity, and having biodegradable binders and coating layers made from water based coatings. The gaming form includes an opaque paper substrate which can be partly recycled fibers in a protein based binder, and defines the base of the form. The base, which is black, is coated with titanium oxide layers to resemble white paper. Indicia affecting the value of the form, for example indicia indicating winning status, is printed on the coating and covered with a non-concealing varnish protective layer, and by a water-based scratch-off coating, which also is environmentally safe. Successive layers of scratch-off coating and the inks applied to the form generally, are water based dispersions of resins, fillers, pigments and surfactants. A non-stick powder is applied as a last step.

16 Claims, 2 Drawing Sheets

GAMING FORM

BACKGROUND OF THE INVENTION

1. Field of the Invention

This invention relates to the field of gaming forms such as lottery tickets, having a scratch-off coating for concealing information which affects the value of the forms, i.e., whether or not a particular form is a winning entry. The form according to the invention, e.g., a lottery ticket, promotional form or the like, comprising an opaque paper substrate, a contrasting opaque coating over a part of the substrate, indicia on the substrate, a non-concealing protective coating over the indicia and a removable coating to conceal the indicia.

2. Prior Art

In the field of gaming forms, preferably lottery tickets, it is known to conceal indicia such as a printed number on a gaming form by a opaque scratch off coating applied after the indicia is printed and before the form is issued to the player. The gaming form substrate is typically a lamination of paper stock and metallic foil such as aluminum foil so that the substrate is opaque and secure prior to use. The scratch-off coating is typically a pigmented soft latex applied over a varnish release layer. The coating is opaque for security and readily removable by scratching the form with a coin or finger nail, so that the player can read the information under the scratch-off coating and determine whether or not the ticket is a winner.

The concealed indicia affects the Value of the gaming form. There are security problems associated with prior art gaming forms, including lottery tickets, which have a number or other printed indicia on the gaming form substrate which is covered with a scratch-off coating. It may be possible, for example, by one or more techniques, to read the information printed under the scratch-off coating without disturbing the scratch-off coating.

One technique involves shining a light or other source of radiation at the side of the card, and attempting to discern the indicia by observing the differences in the amount of radiation passing through to the opposite side. Whereas the printed indicia locally increases the opacity of the form, the indicia may be readable through the scratch-off coating. Typically this candling technique uses bright light at wavelengths in the visible range; however, ultraviolet light, infrared light, or other forms of electromagnetic radiation may also be used to reveal the indicia.

Another technique is to electrostatically charge the form, apply a powder to one side, and observe the pattern in which the powder adheres to the form. Whereas the concealed printed indicia may affect the localized charging conditions, the concealed indicia can be revealed in the pattern of adhered powder.

A further technique involves applying alcohol or a similar solvent to the scratch-off coating, to temporarily reduce the opacity of the scratch-off coating. The coating is not disturbed mechanically, and after the solvent dries the coating regains its opacity without apparent damage to the form.

An unscrupulous person may be led to examine a stock of such forms which are to be sold to the customers, and to extract from the stock those that are determined to be winning tickets. Retail lottery agents, for example, potentially could examine the stock of the forms received from a state lottery agency, and extract the winning tickets before they are sold to players. The tickets could be distributed to conspirators in an attempt to defraud the lottery and the other players.

It is known to discourage attempts to discern indicia printed under a scratch-off coating by printing the outer surface of the scratch-off coating with a so-called confusion pattern. The confusion pattern can be arranged to correspond to segments of the letters or numbers of the concealed indicia, and tends to camouflage the indicia.

It is also known to discourage attempts to discern indicia printed under a scratch-off coating by providing a gaming form which comprises a lamination of paper stock and metallic foil such as aluminum foil. Whereas the metallic foil is substantially more opaque than the ink used to print the concealed indicia, the foil effectively prevents reading of the indicia by shining a light or the like through the lottery form.

The foil is electrically conductive. However, it is disposed under the printed indicia and under the scratch-off coating. Accordingly, the foil does not adversely affect the ability of an unscrupulous person to charge the form, apply a powder, in an attempt to discern the indicia by examining the uneven charge at the surfaces of the form due to the printed indicia.

The foregoing technique is helpful for making it more difficult to read through the scratch-off coating. The foil layer, however, renders the forms non-recyclable and non-biodegradable. Foil lamination is also relatively expensive, both in the cost of materials and in the cost of production. It would be advantageous to provide a gaming form structure which has the same advantages as a laminated foiled card, but which is recyclable and biodegradable, and preferably is made of recycled material.

Recycling has generated much interest in recent years in the United States. Heightened awareness of decreasing natural resources has led the United States to direct its attention to conservation through recycling. It is known that paper is a readily recyclable material. The present invention provides a gaming form that has a base made of recyclable opaque paper, preferably comprising at least a majority of recycled materials, but yet has the same advantages as a laminated foil card.

Known paper making technologies that produce opaque paper stock made from recycled fibers present problems for use in making gaming forms. The recycled paper board industry primarily uses cylinder paper making machines, wherein the recycled paper board is constructed by a layering process. The layering process is necessary to provide a paper made from chopped up and non-aligning recycled fibers. However, a pliable recycled paper board would not provide a gaming form with the desired opacity for security and smoothness for applying indicia to the gaming form.

The layering process creates pliable paper that may be delaminated and rendered less opaque than the printed indicia, thereby allowing attempts to discern the indicia printed under the scratch-off coating by the foregoing techniques. Furthermore, recycled paper has a rough surface due to the non-aligned recycled fibers, which renders it inapplicable to apply an indicia to the gaming form. A Fourdrinier paper making machine produces high quality paper comprising one continuous, non-pliable sheet. No lamination or layering of the paper stock results. Thus, in a gaming form application, it would deter or make difficult the possibility of delaminating the paper base and rendering the form less opaque to discern the printed indicia. It would be advantageous to provide a non-pliable continuous opaque sheet of paper from recycled fibers made by the Fourdrinier process.

Furthermore, non-biodegradable waste and its disposal raises environmental concerns. Landfill disposable sites for non-biodegradable waste are finite in number and eventually will be exhausted. In addition, leachates of heavy metals and other hazardous materials into the surrounding soil and water systems through landfills presents contamination and pollution problems. Disposal of non-biodegradable waste is also a relatively expensive process. The present invention provides a gaming form that has a base made of biodegradable paper and a number of coating layers produced from water-based coatings which are environmentally safe.

It is known to coat recyclable opaque paper made from recycled fibers with a coating composition to render the surface smooth for printing. The present invention further provides a contrasting opaque coating over at least a printable portion of the gaming form that is water-based and environmentally safe and further renders a recyclable opaque paper gaming form comprising recycled fibers smooth for applying indicia to the gaming form.

The scratch-off coating is typically applied in the form of a mixture of thermoplastic rubber or latex, solvent and pigment. When the coating is applied, the solvent evaporates quickly and the rubber and pigment remain. A nonconcealing release coating such as clear varnish or pigmented varnish is applied to the form before the scratch-off coating is applied, over the indicia to be hidden. The release coating allows the player to remove the opaque cover coating by scratching the form with a finger nail, coin or the like, while protecting the indicia.

Solvents in general present environmental and health dangers to humans. The solvents can be ingested by skin contact, by inhalation of vapors, etc. It is virtually unavoidable that workers in the field of solvent printing processes will become exposed to the solvents. Exposure to solvents is widely believed to increase the risk of cancer in humans. Assuming that those involved in the printing process avoid exposure by use of protective equipment, there is still a problem that waste materials, residual solvents in containers, solvents needed to clean operating apparatus, etc., often find their way into the environment. Over time, a facility which regularly handles solvents and materials prepared with, cleaned with or otherwise exposed to solvents, will accumulate potentially dangerous levels.

Known scratch-off coatings which use a dispersion of thermoplastic rubber and pigment in a solvent provide a rubbery consistency for the coating, which is easily applied and readily scratched off. Whereas solvents are undesirable components for environmental reasons, it would be advantageous to provide a comparable coating material with a less dangerous carrier, which would still provide the desirable rubber consistency, opacity, and ease of application. The coating should also dry relatively quickly, without reliance on the high volatility of the carrier.

Industry has attempted to develop coating products in general, including paints, inks and the like, which are carried in water rather than solvent. However, problems are encountered in attempting to provide a water based scratch-off ink, for example to be used for removably concealing information on lottery tickets, promotional forms and the like. Metallic pigments such as aluminum particles react in water to evolve hydrogen gas, a potential explosion problem. Water based acrylic resins also tend to form a film, which is undesirable in a printing process and makes the coating difficult to remove by scratching. It is difficult to provide a water based formulation which is relatively soft and rubbery, for easy scratch-off qualities, but is not hard or tacky when dry or prone to build up on the printing head. For these and other reasons, an effective water based scratch-off ink has not heretofore been available.

It would be advantageous to solve problems of security, environmental safety, recycling, and production of gaming forms in a form which is inexpensive in materials and production complexity, yet serves the other needs noted above.

SUMMARY OF THE INVENTION

It is an object of the invention to provide a gaming form from an opaque paper substrate that provides all the benefits of known gaming form which comprises lamination of paper and metallic foil and is recyclable, biodegradable, and economically made.

It is another object of the invention to provide a gaming form with a substrate made from recycled paper fibers.

It is yet another object of the invention to provide a gaming form with a water-based and environmentally safe contrasting opaque coating composition over at least a printable portion of the gaming form substrate.

It is another object of the invention to provide a gaming form with an environmentally safe nonconcealing, release coating.

It is a further object of the invention to provide a gaming form with a water-based removable scratch-off coating that provides all the benefits of known solvent base compositions, and is environmentally acceptable and economically made.

These and other objects are met in a gaming form, i.e., lottery ticket or the like, and method for constructing the same employing an opaque biodegradable and recyclable paper substrate as the base, preferably made from recycled fibers, and a number of environmentally safe coating layers provided from water based coatings.

There is a need in the gaming industry, particularly in the lottery industry, to provide an economical and environmentally acceptable gaming form.

Applicant's invention provides an economical, environmentally acceptable gaming form that can be made of the compositions set forth below.

The gaming form comprises an opaque paper substrate which defines the base of the form. The opaque paper substrate comprises paper which is recyclable, biodegradable, and further provides the opacity for security. Opacity for security means a opacity sufficient so that until the scratch-off layer is removed, attempts to discern the indicia printed under scratch-off coating are not successful.

The gaming form further comprises a contrasting opaque coating over at least a portion of the opaque paper substrate. This coating provides a smooth surface for applying valued indicia on the gaming form and a contrasting background so that the indicia can be discerned from the opaque paper substrate. The contrasting opaque coating comprises a water-based, environmentally safe polymer and contrasting pigment.

In a preferred embodiment the contrasting opaque coating is coated over both sides of the opaque paper substrate. Coating both sides of the paper substrate aid in providing a tamper-resistant lottery ticket. The contrasting coating is associated by the substrate and act to orient or pull the paper fibers to form a connective system wherein any attempt to remove the coating composition from the one side of the lottery ticket also will remove the other side, thus destroying the lottery ticket and printed indicia.

The gaming form further comprises indicia applied to the coated paper substrate. The indicia provides information as to whether the gaming form is a winner and is therefore the value information of the form.

The gaming form further comprises a non-concealing protective coating over the indicia. The non-concealing protective coating provides that the indicia will not be removed on removal from the scratch-off coating while playing. This protective coating is also environmentally safe.

The gaming form further comprises a removable, scratch-off coating concealing the value indicia. The scratch-off coating is opaque for security. Furthermore, the scratch-off coating is water based and environmentally safe.

These and other advantages of the invention will become more readily apparent as the following detailed description of the invention proceeds.

BRIEF DESCRIPTION OF THE DRAWINGS

There are shown in the drawings the embodiments of the invention as presently preferred. It should be understood that the invention is capable of embodiment in a number of specific arrangements in accordance with the disclosure herein, and reference should be made to the appended claims rather than discussion of exemplary embodiments to better access the scope of the invention in which exclusive rights are claimed. In the drawings:

DETAILED DESCRIPTION OF THE PREFERRED EMBODIMENT

The present invention relates to a gaming form, preferably to a lottery ticket, comprising an opaque paper substrate, a contrasting opaque coating over a portion of the substrate, indicia on the substrate, a non-concealing protective coating over the indicia, and a removable coating to conceal the indicia. As used herein, the term "opaque" refers to the opacity sufficient to preclude premature viewing of the value indicia, i.e., viewing of the value indicia prior to removal of the indicia the removable coating placed over the value indicia. According to the invention, any attempts to discern the value indicia printed under removable coating and above gaming form opaque paper substrate is not possible without at least partial destruction of the integrity of the gaming form thereby alerting gaming officials of any tampering with the gaming form.

Figure 1:
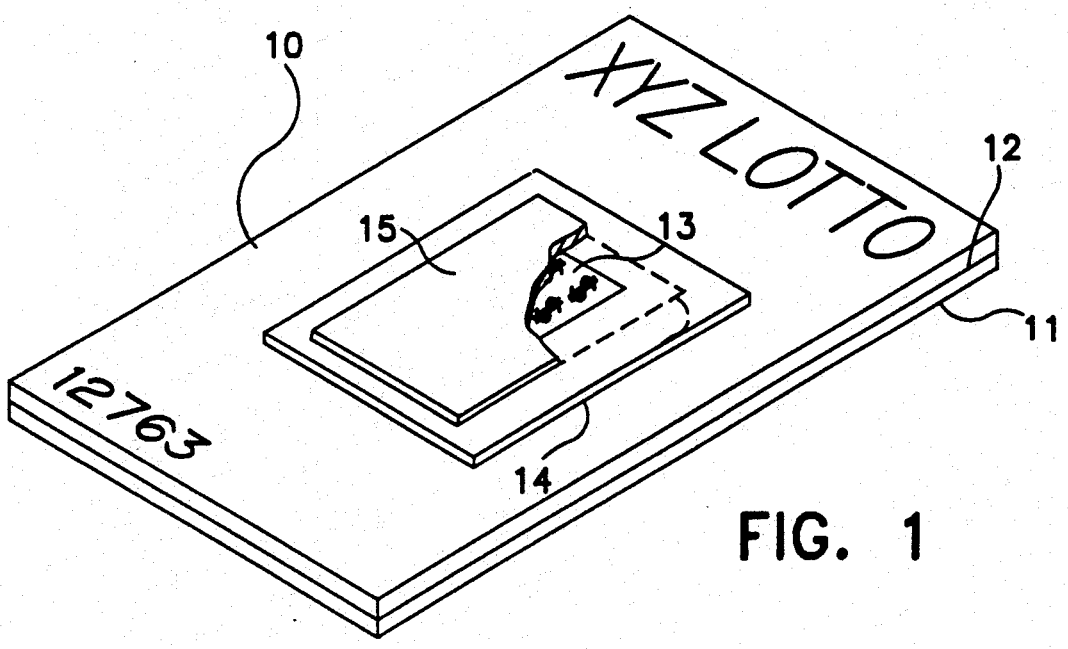
FIG. 1 is a plan, partially cut away view of a gaming form made in accordance with the invention.
Figure 2:
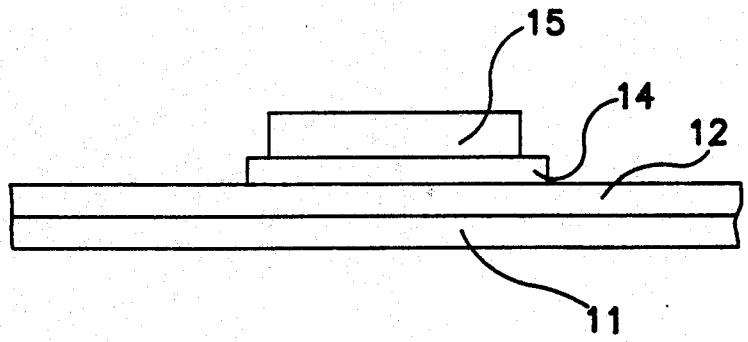
FIG. 2 is a side view of a gaming form shown in FIG. 1.
Figure 3:
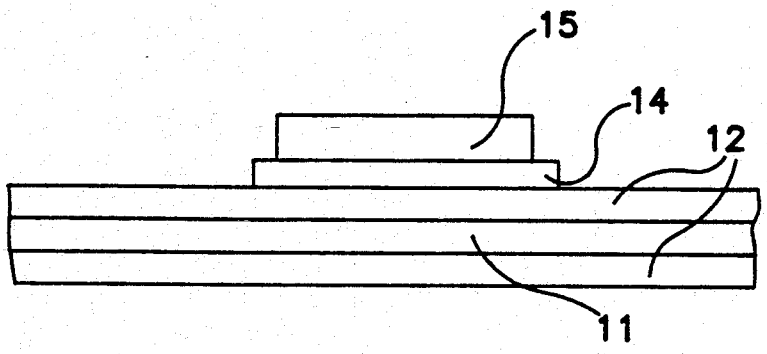
FIG. 3 is a side view of an alternative embodiment of the gaming form shown in FIG. 1.
Figure 4:
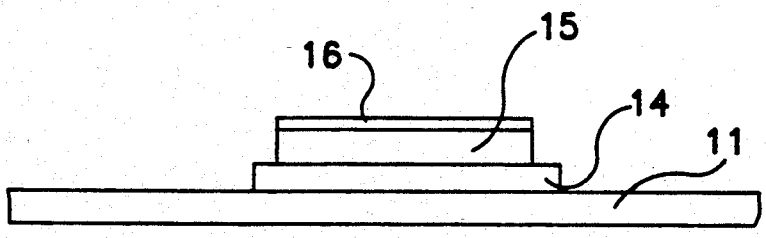
FIG. 4 is a further alternative embodiment of the gaming form shown in FIG. 1.

The gaming form will be described with reference to the drawings, wherein FIG. 1 is a plan, partially cut away view of a gaming form made in accordance with the invention; FIG. 2 is a side view of a gaming form shown in FIG. 1; FIG. 3 is a side view of an alternative embodiment of the gaming form shown in FIG. 1; and FIG. 4 is a further alternative embodiment of the gaming form.

As shown in FIG. 1 the gaming form 10 of the present invention comprises an opaque paper substrate 11, a contrasting opaque coating 12 over at least a portion of the substrate 11, indicia 13 applied to said coated substrate 12, a non-concealing protective coating 14 over said indicia; and, a removable coating 15 concealing said indicia.

The opaque paper substrate 11 may be prepared with use of known Fourdrinier paper making methods to form a continuous, non-pliable opaque paper substrate. The opaque paper substrate may be made from recycled paper stock. However, for strength and binding character of the sheet it is preferred that the opaque paper substrate be made of a combination of recycled paper and virgin fiber. The proportion of recycled paper to virgin fiber required for manufacture on known Fourdrinier paper making equipment varies widely. However, it has been found that opaque paper substrate of optimum quality is obtained when the raw material comprises at least about 20% to about 30%, preferably about 20% virgin fiber and from about 70% to about 80%, preferably about 80% recycled paper.

The desired degree of opacity is provided to the paper substrate 11 by combining carbon black with the slurry of virgin fiber and recycled paper during the Fourdrinier paper making process. Sufficient carbon black should be added to the slurry of virgin fiber and recycled paper to render the paper produced in the Fourdrinier process sufficiently opaque to preclude premature viewing of the value indicia which will be placed on gaming forms made from the opaque paper. Generally, carbon black will be added to the slurry of raw material in an amount of from about 0.1% to about 0.2%, preferably about 0.1%, by so)ids weight based on the solids weight of the slurry.

The carbon black preferably is non-conductive so as to further enhance the security properties of the paper. The use of non-conductive carbon black further allows printing on the opaque paper substrate by electrophotography printing methods. Carbon black does degrade. Thus, incorporation of carbon black in the paper substrate 11 lends degradable characteristics to the gaming form of this invention.

The gaming form 10 further comprises a contrasting opaque coating 12 over at least a portion of the opaque paper substrate 11. The contrasting opaque coating 12 may be made from water-based and environmentally safe coatings made of a combination of polymers, fillers, and pigments. Accordingly, it is preferred that the contrasting opaque coating be made of polyvinyl based polymer resins or natural amino acid based polymer resins. It has been found that contrasting opaque coating of optimum quality is obtained when the raw material comprises approximately 34% filler, 15% resins and 48% water. The contrasting opaque coating 12 is applied over at least a portion of said opaque paper substrate 11 by known coating technologies. Accordingly, it is preferred that the contrasting opaque coating is applied to said opaque paper substrate by an air knife coater. The contrasting opaque coating 12 provides a smooth surface and thus printable for the indicia that determines whether or not the gaming form is a winner. The contrasting opaque coating 12 further provides a contrasting background so that the indicia can be discerned from the opaque paper substrate.

In a preferred embodiment as shown in FIG. 3 is a gaming form 10 wherein the contrasting opaque coating 12 is applied over both sides of the opaque paper substrate 11. The contrasting opaque coating 12 on both sides of the opaque paper substrate 11 orients or pulls the paper fibers to form a connective system, wherein any attempt to remove the contrasting coating from the one side of the lottery ticket also will remove the other side, thus destroying the lottery ticket and the indicia 13. Therefore, the contrasting opaque coating 12 is prepared for security of rheological properties to wet out the opaque paper substrate 10 and flow into the pores of said paper substrate. The amount of penetration is defined by the viscosity of said coating and the porosity of said paper substrate. The degree of opacity is provided to the contrasting opaque coating 12 by pigments, such as titanium dioxide, to contrast the opaque paper substrate 11 and the indicia 13.

In an alternative embodiment as shown in FIG. 4 is a gaming form 10 lacking a contrasting opaque coating 12. The indicia 13 is sufficiently contrasting from the opaque paper substrate 11 to be discernable and render a contrasting opaque coating 12 unnecessary.

The gaming form 10 further comprises indicia 13 applied to said coated substrate. The indicia 13 is typically a number, letter, symbol, or a combination of the three or the like which indicates whether or not the gaming form is a winner or not. The indicia 13 is preferably applied by known printing methods.

The gaming form 10 further comprises a non-concealing protective coating 14 over said indicia 13. Accordingly, it is preferred that the said non-concealing protective coating 14 is applied at least to the area of the form which bears the indicia 13. This provides that the indicia 13 will not be removed on removal from the removable, scratch-off coating while playing. Thus the non-concealing protective coating 14 allows the scratch-off coating to be released cleanly. Accordingly, it is preferred that the non-concealing protective coating 14 is environmentally safe.

The non-concealing protective coating 14 is made from an environmentally safe acrylic polymer. The non-concealing protective coating is further sufficiently transparent to allow a player to view the indicia 13 after removing the removable coating, to determine if the ticket is a winner. The non-concealing protective coating is applied by known printing methods.

The gaming form 10 further comprises that removable coating 15 concealing said indicia 13. Accordingly, it is preferred that this removable coating is made from water-based and environmentally safe acrylic resins, fillers, and pigments. Applicant herein incorporates by reference a removable coating composition set forth in Patent Application S/N not yet known assigned to GTECH INC. entitled, WATER BASED SCRATCH-OFF INK FOR GAMING FORMS. The removable coating 15 preferred includes conductive materials as to prevent attempts to discern the indicia under the scratch-off, removable coating by electrostatically charging the gaming form. The removable coating is applied by known printing methods.

In an alternative embodiment as shown in FIG. 4, the gaming form 10 further comprises a confusion pattern 16 printed over said removable coating 15. The confusion pattern 16 is provided to prevent attempts to discern the indicia under the scratch-off coating.

In another alternative embodiment of the gaming form 10, it further comprises anti-tack materials 17 over said biodegradable gaming forms to prevent tack when forms are packaged on top of each other. It is preferred that the anti-tack material is corn starch.

The foregoing disclosure of the preferred ingredients is intended to be illustrative rather then limiting. Reference should be made to the appended claims rather than the foregoing specification in order to assess the scope of the invention in which exclusive rights are claimed.

We claim:

1. A gaming form comprising:

an opaque paperboard substrate, including paper fibers mixed with a sufficient quantity of carbon black to render said paperboard substrate opaque, the carbon black being dispersed throughout said paper fibers;

a pigment coating on the substrate for concealing the carbon black;

indicia applied to and contrasting with said substrate;

a non-concealing protective coating over said indicia; and, a removable coating concealing said indicia;

whereby the gaming form is rendered secure without incorporating foil.

2. The gaming form according to claim 1, wherein the opaque paperboard substrate is made from about 80% recycled paper fibers and about 20% virgin fibers.

3. The gaming form according to claim 1, wherein the indicia is at least one printed character.

4. The gaming form according to claim 3, wherein said printed character is printed with carbon black.

5. The gaming form according to claim 3, wherein said printed character is printed with ink jet.

6. The gaming form according to claim 1, wherein the non-concealing coating covers at least an area of the substrate including said indicia.

7. The gaming form according to claim 1, wherein the removable coating covers at least an area of the substrate including said non-concealing coating.

8. The gaming form according to claim 7, said removable coating comprising water based acrylic resins, pigments and fillers.

9. The gaming form according to claim 1, further comprising a confusion pattern covering at least said removable coating.

10. The gaming form according to claim 1, further comprising anti-tack material disposed on at least an area of said removable coating.

11. The gaming form according to claim 10, wherein said anti-tack material comprises corn starch.

12. A method for preparing a gaming form, comprising the steps of;

forming an opaque paperboard substrate by mixing paper fibers with a sufficient quantity of carbon black during formation of the substrate to render said paperboard substrate opaque;

applying a pigment coating to the substrate for concealing the carbon black and rendering the substrate similar in appearance to a plain paperboard substrate;

printing contrasting indicia on the opaque paperboard substrate;

applying a non-concealing protective coating to the opaque paperboard substrate over at least that portion of the substrate incorporating said indicia;

applying the removable coating to the opaque paperboard substrate over at least an area of the substrate including the non-concealing protective coating.

13. The method according to claim 12, wherein the opaque paper substrate is produced on a Fourdrinier machine.

14. The method according to claim 12, further comprising applying a confusion pattern.

15. The method according to claim 12, further comprising applying anti-tack material.

16. The method according to claim 12, wherein the paper fibers comprise about 80% recycled paper fibers and about 20% virgin fibers, and wherein the substrate is formed on a Fourdrinier machine.

* * * * *